US008122898B2

(12) United States Patent
Geppert et al.

(10) Patent No.: US 8,122,898 B2
(45) Date of Patent: Feb. 28, 2012

(54) HIGH-PRESSURE APPARATUS AND METHOD FOR REMOVING SCALE FROM A TANK

(75) Inventors: Christian Geppert, Dickinson, TX (US); Stefan Schroth, Dickson, TX (US)

(73) Assignee: Aquajet Ltd., Belize (BZ)

( * ) Notice: Subject to any disclaimer, the term of this patent is extended or adjusted under 35 U.S.C. 154(b) by 421 days.

(21) Appl. No.: 12/478,416

(22) Filed: Jun. 4, 2009

(65) Prior Publication Data

US 2009/0235961 A1 Sep. 24, 2009

Related U.S. Application Data

(63) Continuation-in-part of application No. 11/163,233, filed on Oct. 11, 2005, now abandoned.

(60) Provisional application No. 60/618,488, filed on Oct. 13, 2004.

(51) Int. Cl.
*B08B 3/00* (2006.01)
*B08B 3/12* (2006.01)
*B08B 6/00* (2006.01)

(52) U.S. Cl. ..... 134/180; 134/43; 134/172; 134/174; 134/175; 134/177; 134/184; 134/185; 134/186; 134/187; 134/191; 134/192; 134/194; 134/196; 134/197

(58) Field of Classification Search ..... 134/43, 134/172, 174, 175, 177, 184, 185, 186, 187, 134/191, 192, 194, 196, 197, 180
See application file for complete search history.

(56) References Cited

U.S. PATENT DOCUMENTS 4,056,227 A 11/1977 Fisman
(Continued)

*Primary Examiner* — Michael Barr
*Assistant Examiner* — Charles W Kling
(74) *Attorney, Agent, or Firm* — Law Office of Tim Cook P.C.

(57) ABSTRACT

A rotating and telescoping cleaning system improves high pressure water cleaning of the inner surfaces of vessels or tanks. Vessels can be vertically divided with dividing plates with centered through-holes. Synchronized and controlled transverse and rotary movements of water jets result in a controlled spiral or helical cleaning track along the vessel walls. The water jets are directed at a pre-adjusted distance from the vessel wall and the travel speed of the water nozzle jets is exactly controlled allowing the removal of very hard deposits. One pass with the tool carrier with operating water jets along the length axis of the vessel results in a thoroughly cleaned vessel wall. The tool unfolds and folds inside of the vessel powered by the flow of the high pressure cleaning water.

10 Claims, 3 Drawing Sheets

U.S. PATENT DOCUMENTS

| | | | |
|---|---|---|---|
| 4,214,705 | A | 7/1980 | Watts et al. |
| 4,220,170 | A | 9/1980 | Hebert et al. |
| 4,341,232 | A | 7/1982 | Maton |
| 4,351,478 | A | 9/1982 | Looper |
| 4,664,720 | A | 5/1987 | Rucker |
| 5,056,716 | A | 10/1991 | Robinson |
| 5,169,069 | A | 12/1992 | Rucker |
| 5,518,553 | A | 5/1996 | Moulder |
| 5,594,973 | A | 1/1997 | Brusseleers et al. |
| 5,640,982 | A | 6/1997 | Landry et al. |
| 5,718,382 | A | 2/1998 | Jaeger |
| 5,896,871 | A | 4/1999 | Larsen |
| 5,947,387 | A | 9/1999 | Zink et al. |
| 5,954,271 | A | 9/1999 | Le |
| 6,039,056 | A | 3/2000 | Verbeek |
| 6,059,202 | A | 5/2000 | Zink et al. |
| 6,085,994 | A | 7/2000 | Zink |
| 6,460,553 | B1 | 10/2002 | Owens et al. |
| 6,745,955 | B2 | 6/2004 | Kronz |
| 2009/0095322 | A1 * | 4/2009 | Wakao et al. ..... 134/8 |

* cited by examiner

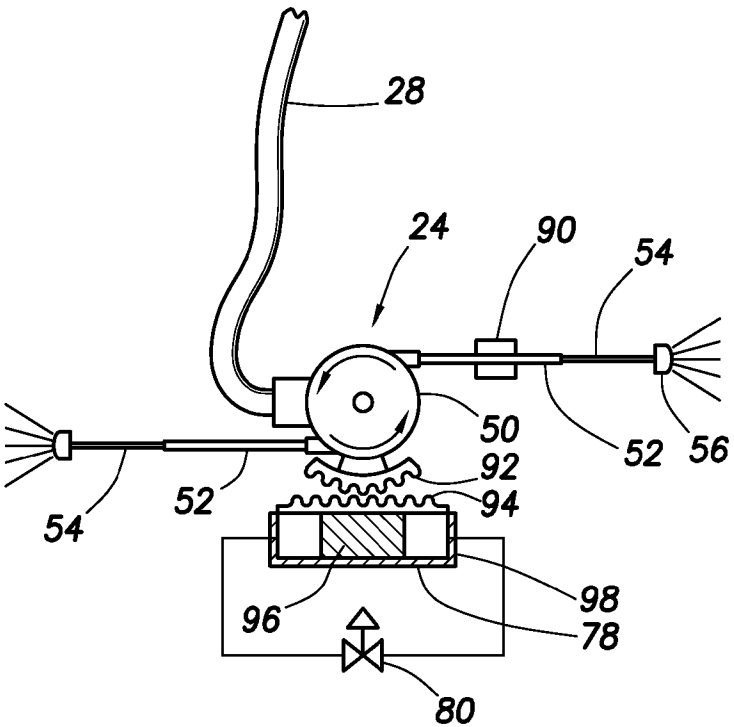
FIG.4
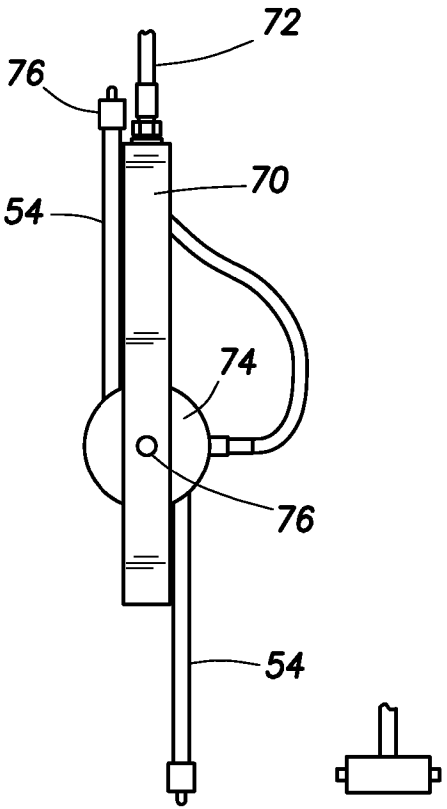
FIG.3B
FIG.3C
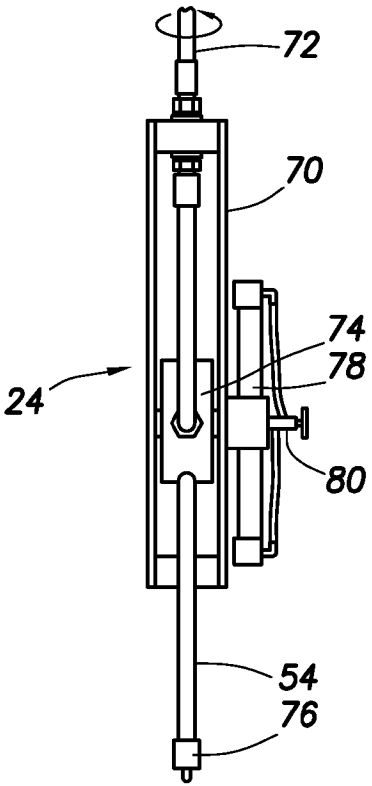
FIG.3A

HIGH-PRESSURE APPARATUS AND METHOD FOR REMOVING SCALE FROM A TANK

This is a Continuation-in-Part of U.S. patent application Ser. No. 11/163,223, filed Oct. 11, 2005, which application claims priority from Provisional U.S. patent application Ser. No. 60/618,488 filed Oct. 13, 2004.

FIELD OF THE INVENTION

The present invention relates generally to the field of systems for cleaning the interiors of tanks by removing scale build-up using a fluid at high pressure and, more particularly, to a system and method for altering the axis of rotation and diameter of spray nozzles in such a cleaning system to maximize the efficiency of the cleaning process.

BACKGROUND OF THE INVENTION

Most tanks in chemical plants, refineries, and similar factories are custom designed vessels that have to be cleaned periodically. Since the tanks are custom designed and thus may have different interior geometries, no one cleaning system will work adequately for all tanks. Furthermore, vessels are typically divided with dividing plates which include centered through-holes or partially removable dividing plates. Also, many processes in these types of plants or factories leave a hard, tenacious scale on interior surfaces of tanks, which presents an especially difficult cleaning problem.

Commonly, such a tank has an entry point or access way which is small relative to the interior diameter and height of the tank. On the other hand, a typical tank has relatively large inner surface areas which require periodic cleaning to remove the buildup of materials left by the material kept in the tank, such as calcium and magnesium carbonates and similar residues. Thus, a single manufacturing facility may have a wide variety of tanks of varying sizes, each requiring this sort of periodic maintenance and at least some of the tanks presenting a different aspect of interior geometry versus the size of the entry point or access way.

That restriction presents the engineering dilemma of having to insert the tool through a small opening (so the tool has to be small), but requiring a substantial distance for a water jet from the tool, in order to reach the farthest surfaces of the interior of the tank. To remove hard scale from the interior surfaces of a tank, the water jet must be operated at a high pressure, for example at least 9,000 psi, and the jet must be positioned in close proximity to the tank wall surface, for example at six inches or closer, in order to be effective.

With all of these factors in mind, one can see that it is difficult to find a single cleaning tool that fits all tank sizes and applications while doing a good job of cleaning the interiors of all of the tanks. One current proposed solution available on the market uses a small volume, high pressure water cleaning tool that is positioned inside the vessel and moved along the center axis of the tank while several water jets rotate around one or two axes simultaneously. Since the water jets are directed more or less radially from one point inside the tank, the distances from the water jet exit ports to the vessel walls are substantial and change continuously. For portions of the interior tank wall that are more than six inches from the water jet, hard scale is not removed and remains on the wall For this type of water jet cleaning system, surface coverage cannot be exactly controlled since the water jet tracks contact the interior surface of the tank at more or less random locations. For proper surface coverage, each track of the water jet should overlap the previous track by a small amount. If the track does not overlap a previous track, then a portion of the interior surface of the tank will not be cleaned. If there is too great an overlap, then the track will be directed too much to a portion of the interior surface which has already been cleaned and the process is therefore inefficient.

However, in many known systems, the tracks of the jets are directed more or less randomly. That means that in order to insure that the entire interior surface of the tank is cleaned, the cleaning process must be continued for a much longer period of time than would be required if the direction of the spray of the jets could be more closely controlled. Such systems are also inefficient since the majority of time the spray from the jets is not effective directed to the wall of the vessel, but either up or down away from the surface to be cleaned.

Furthermore, since the distance from the center axis of the tank, where the jets are typically located, to the interior surface of the tank may be several feet, hard deposits cannot be adequately removed and thus the cleaning process is more a flushing process.

Systems for cleaning the interior surfaces of a tank encounter another serious problem in that the inside of the tank typically includes structural support plates extending laterally inwardly toward the axis of the tank. These plates represent surfaces which must be cleaned, and also present obstacles for the movement of the cleaning tool within the tank or vessel. As the cleaning tool is lowered into a tank from an access point at or near the top of the tank, the interior obstacles within the tank must be considered when directing a high velocity jet from a point off the axis of the tank.

Another proposed solution to the problem of the variations in interior geometries of tanks to be cleaned takes advantage of automation technology. The interior geometry of the tank, including inside diameter, height, and interior obstacles, are set into a programmable controller and the tool is then run into the tank. Unfortunately, such systems are highly complex, require a long setup time, and are very heavy and expensive. Further, the time and expense required to program and debug the programmable controller is often longer and greater than the total cost of a satisfactory cleaning job without such a controller. Since the system must be re-programmed for each tank geometry, such systems are currently not cost effective.

Thus, there remains a need for a system for cleaning the interior surfaces of tanks which is flexible, effective, and efficient. The present invention is directed to filling this long felt need in the art.

SUMMARY OF THE INVENTION

The present invention addresses these and other drawbacks in the art to improve high pressure water cleaning of inner surfaces of tanks or vessels. This improvement is achieved by the tool's ability to unfold and fold so that the tool easily fits through small access openings and at the same time allowing the water jets to be positioned at optimal distances relative to the vessel wall for superior cleaning results, i.e. six inches or less from the water jets to the vessel wall, preferably between one and six inches. The folding and unfolding process is powered only by the water jet force and water pressure supplied to the jets. The folding and unfolding process is speed controlled using dampening devices. In the present invention, no electric or electronic components are used.

This invention synchronizes the transversal and rotational movements of water jets. While the jets are directed at a pre-adjusted distance to the vessel wall, they are moved in three dimensions. This movement results in a controlled spiral or helical cleaning track along the vessel walls. The travel speed of the water jets and the distance between adjacent cleaning tracks can be adjusted to match the cleaning needs so that there is a predetermined overlap from one cleaning track to the next. In this way, the entire inner surface of the vessel can be covered precisely. Once the cleaning tool has been moved from one end of the vessel to the other with the travel of the water jets controlled in that manner the vessel wall will have been thoroughly cleaned. The exact positioning of the water jets allows the removal of very hard deposits.

The rotational movement is powered either by water or air flow. A pneumatic-hydraulic device is used to convert the rotational movement into the additional transversal movement.

Thus, the present invention provides a vessel cleaning system for cleaning storage tanks, reactors, etc. in all industries. The system of this invention is directed to cleaning many different types of deposits, especially very hard deposits from vessel walls using high pressure water jets. A spray sub-system comprises a tool carrier with water jet nozzles attached thereto which unfolds by rotating and telescoping inside the vessel at the start of a cleaning cycle and folds up at the end of the cleaning cycle. The unfolding and folding procedure is required to get the tool carrier in and out of the tank through a relatively small access so that the cleaning system is still able to position water jets at a required distance to a vessel wall and therefore deposits to be removed from the vessel wall. The unfolding and folding procedure is speed controlled and simultaneously used to clean certain areas inside the vessel.

The unfolding and folding operation is strictly a mechanic and/or hydraulic process initiated with the starting and stopping of and powered by the high pressure water flow only. A combined rotational and transverse movement of the tool carrier and the unfolding and folding movement is controlled in a way that results in a spiral movement of the water jets when cleaning two dimensional flat surfaces and in a helical movement of the water jets when cleaning cylinder walls. All movements are speed controlled: the travel speed of jets and the pitch of the spiral and the helix are adjusted depending on the cleaning requirements for the deposit to be removed from the vessel wall. Impact properties of water jets on deposited materials can be maintained constant throughout the cleaning operation.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 3A is a side view of a tank cleaning sub-system.

FIG. 3B is a front view of the tank cleaning sub-system of FIG. 3A.

FIG. 3C is a detail view of an alternative spray nozzle for use on the tank cleaning sub-system.

FIG. 4 is a section view of a damping device for controlling the rate of rotation of a spray sub-system.

DETAILED DESCRIPTION OF PREFERRED EMBODIMENTS

Figure 1:
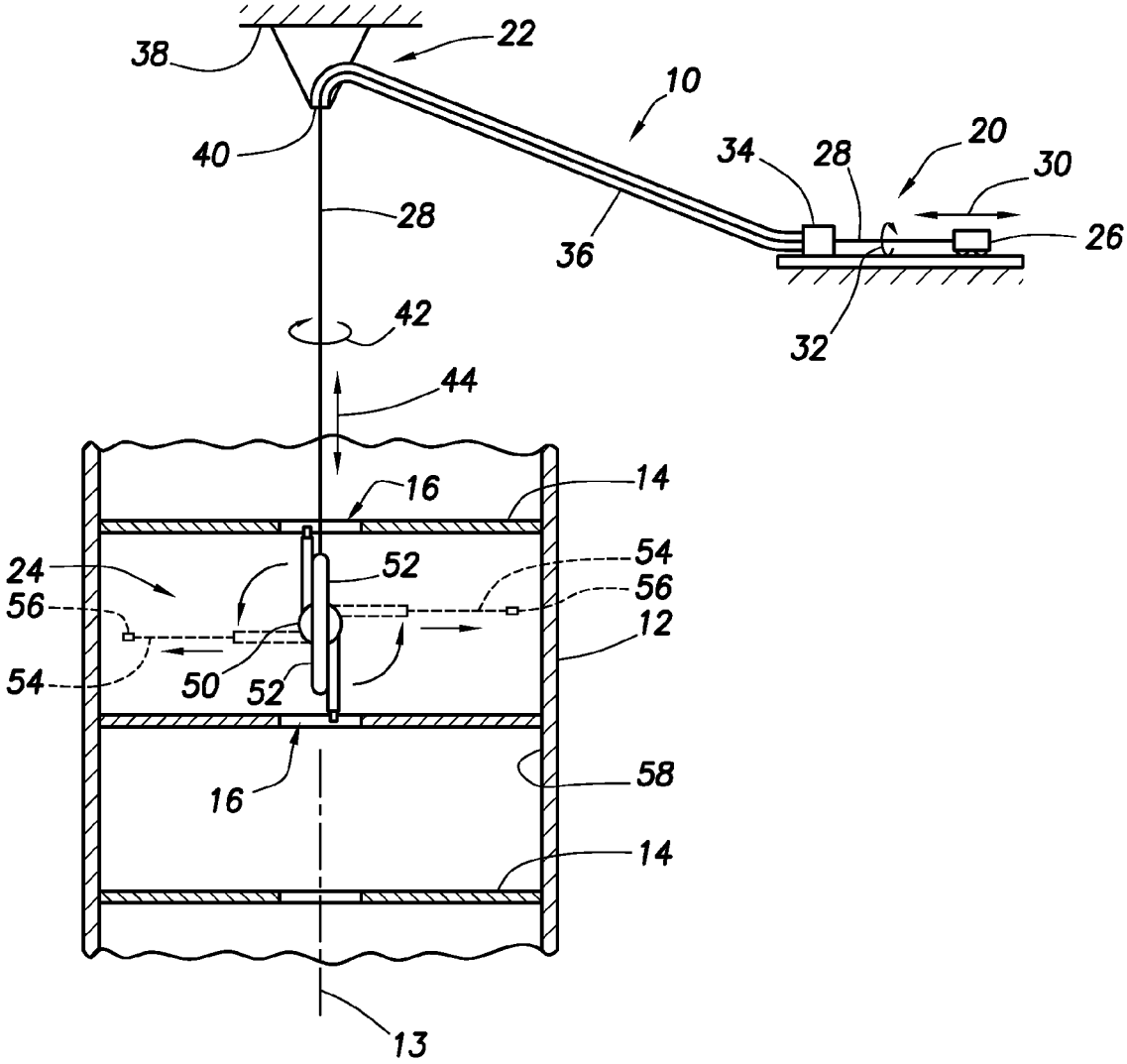
FIG. 1 is a side section view of a tank cleaning system of the present invention in use within a tank having horizontally disposed dividing plates with vertical channels through the plates.

FIG. 1 illustrates a presently preferred embodiment of the tank cleaning system 10 of this invention in a tank 12 with dividing plates 14 and a center hole 16 in each dividing plate. The tank is circular in cross section and oriented vertically along an axis 13. It should be understood that only a portion of the tank 12 is illustrated, and it may extend a substantial distance above and/or below the portion illustrated in FIG. 1.

The system 10 comprises a feed sub-system 20, a support 22, and a nozzle jet sub-system 24. The feed sub-system 20 includes a prime mover 26 which imparts lateral movement to a feed tube 28 as shown by an arrow 30. The prime mover 26 also imparts rotational movement to the feed tube 28, as shown by an arrow 32. The feed tube carries fluid, typically water, under high pressure for cleaning the interior of the tank 12 as described in greater detail below. The high pressure fluid is provided by a high pressure source, typically a compressor (not shown) at at least 9,000 psi., and preferably at least 10,000 psi. in order to cut hard scale from the interior surface of the tank 12.

The prime mover thus controls the lateral and rotational movement of the feed tube. The lateral movement of the tube is controlled at such a rate as to create a controlled helical movement of the spray from the nozzle jet sub-system 24 for complete and efficient cleaning, as described further below.

The feed tube 28 passes through and is supported by a feed pedestal 34 which also serves to support a feed tube sheath 36. The feed tube sheath is a flexible, non-rotating conduit through which the rotating feed tube passes. The other end of the feed tube sheath 36 is coupled to the support 22, which is typically mounted to a structural member 38 in the vicinity of the tank 12. The feed tube sheath 36 has an opening 40 through which the feed tube 28 passes. The feed tube 28 is then directed downwardly into the tank 12, where it continues to rotate as shown by an arrow 42. Also, movement back and forth of the prime mover 26 as shown by the arrow 30 results in lateral movement of the feed tube 28 as shown by an arrow 44. Thus, the jet sub-system 24 is supported by the feed tube and pulls down on the feed tube by force of gravity. Further, the jet sub-system 24 travels within the tank 12 coincident with the axis 13 of the tank.

The nozzle jet sub-system 24 is illustrated in FIG. 1 already deployed within the tank 12. While FIG. 1 is not necessarily to scale, it should be recognized that the horizontal diameter of the tank is large compared to the horizontal diameter of the center hole 16, so that the nozzle jet sub-system must be small enough in its own horizontal diameter to pass through the center hole 16. Once through the center hole 16, however, the nozzle jet sub-system must then direct high pressure fluid against the interior surfaces of the tank in order to adequately clean these surfaces. The present invention accomplishes this difficult task by providing two motions to the nozzle jet sub-system, to be described below in greater detail.

The nozzle jet sub-system 24 comprises a centrally disposed swivel 50 with at least two arms 52 extending therefrom. It should be noted that each such arm 52 must have a corresponding arm extending in the opposite direction (i.e. 180° therefrom) in order to counteract the thrust created by the jets. While the nozzle jet sub-system is being deployed within the tank 12, the arms 52 extend substantially vertically, i.e. parallel with the direction of travel of the system and coincident with the axis 13 of the tank. Once the nozzle jet sub-system is properly positioned about midway between dividing plates 16, the arms are rotated to a horizontal positioned, as shown in phantom in FIG. 1. Then, nozzle extensions 54 telescope out to a deployed position, carrying a nozzle jet 56 on the end of each nozzle extension 54 to a position six inches or less from an interior surface 58 of the tank 12. It should be noted that the arms 54 may also be flexible to assist in drawing them through small access holes or center holes in dividing plates.

To clean vessel walls 58, the sub-system 24 must be properly positioned within the tank between divider plates. Once a portion of the tank is cleaned, the sub-system 24 is collapsed, repositioned through center hole 16, and redeployed to clean the next portion of the tank. Thus, the distance between dividing plates within the tank must be greater than the length between nozzle jets before the extension arms are extended so that the sub-system 24 can freely rotate into position between divider plates. Further, once the sub-system 24 is horizontally deployed with the jets near the interior surface of the tank, the sub-system is then lifted until the extension arms, which are now parallel to the dividing plates, are as close as possible to the dividing plate immediately above the sub-system 24 so that the portion of the inside surface of the tank immediately beneath the divider plate will be properly cleaned.

Once the sub-system 24 is properly positioned within the tank, the feed tube 28 is pressurized with fluid, typically water at 9,000 psi or more, preferably at least 10,000 psi. The nozzle jets 56 are then activated and the telescopic extension arms 54 extend, thereby positioning the nozzle jets 56 to within 6" of the vessel wall 58. No dampening of extension arm movement is applied. With the activation of the nozzle jets, the sub-system 24 is then rotated about the vertical axis of the tank to direct the jet spray around the interior surface of the tank, as controlled by the feed system 20.

With the start of the rotation of the sub-system 24, the sub-system 24 is then lowered by feeding the high pressure feed hose 28 at a controlled feed rate. The feed rate is determined by a predetermined length of feed for each rotation of the sub-system 24 to provide some overlap for each track of the spray against the interior surface of the tank. Since there are two opposing jets, the track of one jet is interleaved with the track of the opposing jet. Each jet thus forms a spiral track that overlaps the next adjacent track formed by the other jet, and the spiral centers on the axis 13. As used herein, the term "track" refers to the area contacted by one jet spray.

Once the sub-system 24 has been lowered as much as possible, thereby cleaning the portion of the tank between the dividing plates, the nozzle jets are stopped and the telescopic arms are retracted. The sub-system 24 is then centered between the dividing plates and the extension arms are rotated into a vertical position. The tank cleaner can now be lowered in the next tank section between the next set of dividing plates.

Note that the preceding detailed description was directed to cleaning the interior surfaces of the tank in between dividing plates. However, the dividing plates themselves must also be cleaned. To clean dividing plate surfaces, two jets per extension arm are installed with the jet direction vertically up and down parallel to the vessel center axis 13 when in operation. The sub-system 24 is positioned along the axis of the tank and then lowered into the individual tank sections with the extension arms in a vertical position as previously described. When the sub-system 24 is positioned in the center between two dividing plates, the extension arms are rotated into a horizontal position. The sub-system is then lifted until the extension arms, which are now parallel to the dividing plate, are as close as necessary to the upper dividing plate for proper cleaning results.

The nozzle jets are then activated and the telescopic extension arms extend at a preset speed, determined by a dampening system. The system then operates as previously described, this time to spray a high pressure fluid against the bottom surface of the dividing plate above the sub-system 24 and the top surface of the dividing plate below the sub-system 24. The rotational speed of the sub-system 24 is coordinated with the extension speed of the telescopic arms 54 so that the resulting movement of the water nozzle jets is a spiral pattern with some overlap from one spray track to the next.

We have found that the jets which face in a downward direction have less of a cleaning effect on the lower dividing plate than the upwardly directed jets. However, the downwardly direction jets must be active as a counter force to the jets facing up to provide a balanced force acting upon the ends of the extension arms.

Once the extension arms have extended all the way to their full extent, water pressure through the feed tube 28 is stopped and the extension arms retract. The sub-system 24 is then lowered until the extension arms are as close as necessary to the lower dividing plate. The process is then repeated with the cleaning of the top surface of the lower dividing plate in a manner just described in respect of the dividing plate above the sub-system 24. After cleaning both dividing plate surfaces, the system is centered between the dividing plates and the extension arms are rotated into a vertical position. The sub-system 24 is then lowered into the next tank section.

Figure 2:
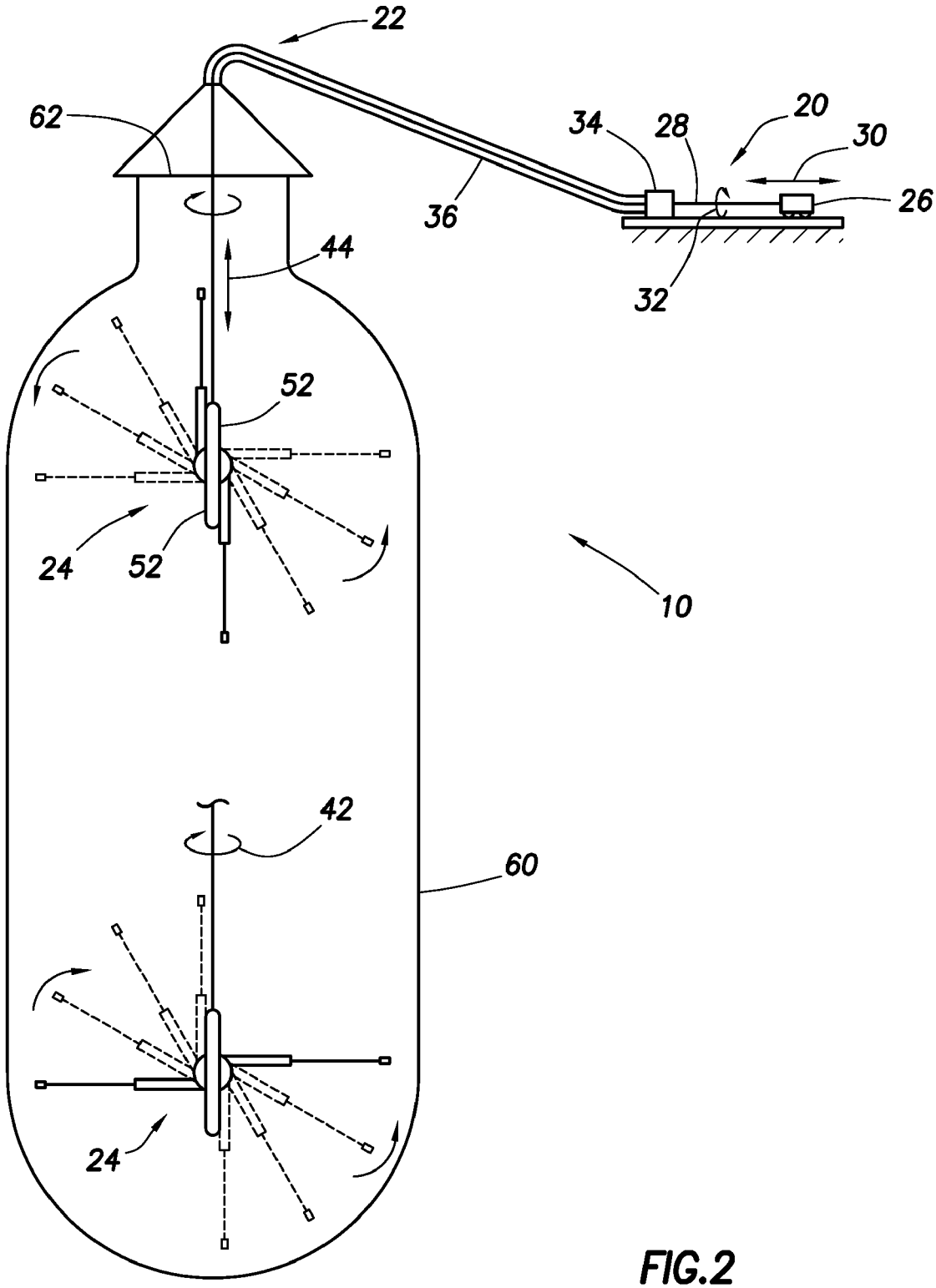
FIG. 2 is a side section view of the tank cleaning system within a tank with no internal dividing plates.

FIG. 2 illustrates the application of the tank cleaning system 10 in an open tank 60 without dividing plates or internally installed moving parts. As previously described, the system 10 comprises the feed sub-system 20, the support 22, and the nozzle jet sub-system 24. The feed sub-system 20 includes the prime mover 26 which imparts lateral movement to the feed tube 28 as shown by the arrow 30. The prime mover 26 also imparts rotational movement to the feed tube 28, as shown by the arrow 32.

The feed tube 28 is flexible and passes through and is supported by the feed pedestal 34 which also serves to support the feed tube sheath 36. The other end of the feed tube sheath 36 is coupled to the support 22, which in the embodiment illustrated in FIG. 2 is adapted to mate with an upper access port 62 of the tank 60. The feed tube 28 is then directed downwardly into the tank 60, where it continues to rotate as shown by the arrow 42. Also, movement back and forth of the prime mover 26 as shown by the arrow 30 results in up and down movement of the feed tube 28 as shown by the arrow 44.

In the embodiment of FIG. 2, the cleaning apparatus is positioned along the center axis of the tank 60 near the top of the tank, with the distance of sub-system 24 to the top of the tank equal to the radius of the vertical part of vessel. The length from the center of the sub-system 24 to the water jet outlet nozzles equals the horizontal radius of the vessel minus the distance for an individual jet outlet to the vessel wall for best cleaning results, from one to six inches. If the nozzle is too close to the vessel wall, the jet is too narrow, resulting in a pencil beam of water against the vessel wall and inadequate overlap from one track to the next. If the nozzle is too far from the vessel wall, the water spray has too little force to clean certain tenacious depots on the vessel wall.

With the initial positioning of the sub-system 24, the extension arms are vertical, one jet facing the top of the vessel and one jet facing the bottom. When activated, the lower jet will typically be too far from the bottom of the tank to have much of a cleaning effect. Once the water jets are activated, the extension arms will rotate to a horizontal position. Also, simultaneously with the activation of the jets, the sub-system 24 will begin to rotate about the vertical axis, beginning a cleaning action along the inside top surface of the tank. This additional rotation is provided by the prime mover 26 through rotation of the feed tube 28. The rotational speed around the vertical axis is coordinated with extension arm rotational speed around the sub-system 24, so that the resulting spiral pattern track of water jets on the vessel wall provides an overlap of one jet track to the next. The distance between tracks and traveling speed of the water jets may require some adjustment, depending on type of material that has to be removed from the tank walls.

Once the extension arms have reached a horizontal position, the sub-system 24 is lowered into the tank with its rotation around the tank vertical axis maintained, thus creating a spiral cleaning track down the wall of the vessel. The cleaning apparatus is lowered by feeding the high pressure water feed tube at a controlled feed rate in relation to the rotational speed of the sub-system 24. The prime mover 26 coordinates the rotation of the cleaning apparatus around the vertical tank axis and the downward movement of apparatus.

The downward movement of the apparatus is stopped once the apparatus reaches a position in the center of the vessel with a distance of the sub-system 24 to the bottom of the vessel equal to the radius of the vertical part of the vessel, thus the distance of the jet outlet to the vessel wall required for best cleaning results will be reached. Now the extension arms will be rotated back into vertical position at the same rotational speed as they were rotated into horizontal position at the beginning of the cleaning process with the high pressure water pump continuing to run. With the tank cleaner rotation along the tank vertical axis maintained the jet moving towards the lower center of the tank will clean the bottom in a spiral pattern. Alternatively, the supply of pressurized water through the feed tube may be stopped, and the extension arms rotated into a vertical position and the same procedure as in the very beginning is repeated to clean the bottom of the tank by starting at a vertical position and moving in a controlled fashion to a horizontal position. However, at the end of the cleaning process, the arms are returned to a vertical position in order to pull the tank cleaner out of the tank.

FIGS. 3A and 3B depict a presently preferred embodiment of the sub-system 24, which may be referred to herein as the "tank cleaner". FIG. 3C depicts an alternative spray nozzle for use on the sub-system 24 for cleaning dividing plates within a tank as described above, in which spray outlets from the nozzle are directed in diametrically opposed directions.

The sub-system 24 includes a frame 70 suspended by the rotating high pressure water hose or feed tube 72 in the center of the tank. A center plate 74 is held by the suspended frame and supported by a bearing 76 that allows the plate to rotate around an axis perpendicular to the vessel center axis 13. The two extension arms 54 are coupled to the center plate, with one water jet insert 76 each at the end of each extension arm. The extension arms may vary in length, depending on the specific cleaning job or application. The jet directions and extension arm length axes are in the same geometrical plane perpendicular to the rotational axis of the center plate, and jet forces of the two jets match each other and are directed in opposite directions with one jet presenting the counter force to the other jet.

The jet and extension arm length axes are offset, thus, the jet reaction forces generate a torque with a direction perpendicular to the vertical tank center axis. This torque rotates the center plate with the extension arms. The rotational movement is dampened by a hydraulic cylinder 78 and restricted to 90° between vertical and horizontal extension arm positions. The damping can be adjusted with an adjustable orifice 80 in order to control the rotational speed of extension arms.

FIG. 4 depicts a schematic view illustrating the damping feature of the spray sub-system 24. As previously described, the sub-system 24 is fed with high pressure fluid from a tube 28, which is coupled into the swivel 50. Fluid pressure is directed through the arms 52 and the extensions 54, creating a moment to rotate the swivel as shown by the arrows in FIG. 4. Rotation of the swivel 50 rotates a pinion gear 92 which meshes with a rack 94. The rack 94 is joined to a piston 96 within a cylinder 98. Moving the rack to the right pushes hydraulic fluid from the cylinder to the right out through the adjustable orifice 80 to the other side of the piston 96. Thus, the rate of rotation of the swivel is controlled by the setting on the orifice 80.

Preferably, the orifice 80 is an adjustable throttle check valve. The spray sub-system 24 is shown in FIG. 4 at the full horizontal position. Once the spray process with the spray sub-system in the horizontal position is complete, the arm extensions retract and the swivel rotates to place the arms in a vertical position. A weight 90 provides a biasing means to pull the arms to a vertical position. To aid in this movement, the orifice includes a check valve which permits unrestricted flow from left to right as seen in FIG. 4 to more quickly move the arms to a vertical position. The arm extensions 54 also include a biasing means to assist in retracting the arm extensions when the high pressure fluid is no longer being supplied to the spray nozzles 56.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A tank cleaning system for cleaning interior surfaces of a vertically oriented tank having an inside diameter and an inside circumference of substantially circular cross section, the tank defining a central vertical axis, and the tank having an access defining a diameter less than the inside diameter, the cleaning system comprising:

a. a feed sub-system comprising a prime mover adapted to be positioned outside the tank to be cleaned;

b. a support spaced above and outside the access, wherein the feed sub-system is positioned laterally of the support;

c. a spray sub-system comprising:

at least two fluid spray nozzles, each of which makes a track against the interior surface;

a telescoping arm to which each of the at least two fluid spray nozzles is mounted;

means to collapse the spray sub-system to a horizontally measured diameter less than the diameter of the access and to expand the spray sub-system to a horizontally measured diameter greater than the diameter of the access when the spray sub-system is positioned within a tank for cleaning to position the spray nozzles to between one and six inches from the interior surfaces of the tank, the spray sub-system directed along the vertical axis of the tank; and a damping system to control a first rate at which the spray sub-system collapses to a horizontally measured diameter less than the diameter of the access and further controls a second rate at which the spray sub-system expands to a horizontally measured diameter greater than the diameter of the access; and d. a flexible feed tube which conducts high pressure fluid of at least 9,000 psi. from the feed sub-system to the spray sub-system; wherein the prime mover develops lateral and unidirectional rotational movement in the feed tube; and further wherein the feed tube suspends the spray sub-system within the tank by gravity.

2. The cleaning system of claim 1, wherein lateral movement in the feed tube creates vertical movement of the spray sub-system.

3. The cleaning system of claim 1, wherein rotational movement of the feed tube creates rotational movement of the spray sub-system.

4. The cleaning system of claim 1, further comprising a flexible arm to which each of the at least two spray nozzles is mounted.

5. The cleaning system of claim 1, further comprising a feed tube sheath between the feed sub-system and the support, wherein the feed tube sheath surrounds the feed tube.

6. The cleaning system of claim 1, wherein the support is mounted to the access.

7. The cleaning system of claim 1, wherein the spray nozzle includes outlet jets directed in diametrically opposed directions.

8. The cleaning system of claim 1, wherein the feed sub-system synchronizes lateral and rotation movement of the spray sub-system so that the track of one jet overlaps the track of an opposing jet.

9. The cleaning system of claim 8, wherein each track defines a spiral pattern on the interior surface.

10. A tank cleaning system for cleaning a tank having an inside diameter of an interior surface and an access having a diameter less than the inside diameter, the cleaning system comprising:

a feed sub-system comprising a feed tube and a prime mover which controllably moves the feed tube in lateral and unidirectional rotational directions;

a support spaced above and outside the access;

a jet spray sub-system moved in up and down directions in response to the lateral motion of the feed tube and in a rotational direction in the response to rotational direction of the feed tube, the jet spray sub-system comprising:

at least two fluid spray nozzles;

a telescoping arm to which each of the at least two fluid spray nozzles is mounted;

means to collapse the jet spray sub-system to a horizontally measured diameter less than the diameter of the access and to expand the jet spray sub-system to a horizontally measured diameter greater than the diameter of the access when the jet spray sub-system is positioned within a tank for cleaning; and a damping system to control a first rate at which the jet spray sub-system collapses to a horizontally measured diameter less than the diameter of the access and further controls a second rate at which the jet spray sub-system expands to a horizontally measured diameter greater than the diameter of the access;

wherein the jet spray sub-system directs high-pressure water of at least 9,000 psi onto the interior surface of the tank from a distance measured by a range of from one to six inches.

* * * * *